US008419861B2

(12) United States Patent
Rosenbauer

(10) Patent No.: US 8,419,861 B2
(45) **Date of Patent: *Apr. 16, 2013**

(54) METHOD FOR ADAPTING A RINSING PROGRAM IN A DISHWASHER MACHINE, AND CORRESPONDING DISHWASHER MACHINE

(75) Inventor: Michael Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/311,605

(22) Filed: Dec. 6, 2011

(65) Prior Publication Data

US 2012/0073605 A1 Mar. 29, 2012

Related U.S. Application Data

(63) Continuation of application No. 11/043,237, filed on Jan. 26, 2005, now abandoned, and a continuation of application No. PCT/EP03/09245, filed on Aug. 20, 2003.

(30) Foreign Application Priority Data

Aug. 21, 2002 (DE) ..... 102 38 304

(51) Int. Cl.
*B08B 7/04* (2006.01)

(52) U.S. Cl.
USPC ..... 134/18; 134/25.2

(58) Field of Classification Search ..... 134/18, 134/56 R, 58 D, 113, 25.2
See application file for complete search history.

(56) References Cited

U.S. PATENT DOCUMENTS

| | | | | |
|---|---|---|---|---|
| 5,725,001 | A | 3/1998 | Vogel | |
| 5,806,541 | A * | 9/1998 | Cooper et al. | 134/57 D |
| 6,800,598 | B1 | 10/2004 | Waeschenbach et al. | |
| 6,887,318 | B2 * | 5/2005 | Bashark | 134/18 |
| 7,704,330 | B2 * | 4/2010 | Rosenbauer | 134/18 |
| 2003/0079760 | A1 * | 5/2003 | Spanyer et al. | 134/18 |
| 2003/0213503 | A1 * | 11/2003 | Price et al. | 134/18 |
| 2003/0213505 | A1 | 11/2003 | Price et al. | |

FOREIGN PATENT DOCUMENTS

| | | | |
|---|---|---|---|
| DE | 2949254 | C2 | 6/1981 |
| DE | 3731096 | A1 | 4/1989 |
| DE | 3839204 | A1 | 5/1990 |
| DE | 4243868 | A1 | 7/1994 |
| DE | 29514412 | U1 | 11/1995 |
| DE | 19512011 | A1 | 10/1996 |
| DE | 19629806 | A1 | 1/1998 |
| DE | 19650915 | A1 | 1/1998 |
| DE | 19643151 | A1 | 4/1998 |
| DE | 19651347 | A1 | 6/1998 |
| DE | 19749636 | A1 | 5/1999 |
| DE | 19957243 | A1 | 5/2001 |
| DE | 10027844 | A1 | 6/2001 |
| DE | 10049489 | A1 | 4/2002 |
| DE | 10057210 | A1 | 5/2002 |
| EP | 0741991 | A1 | 11/1996 |
| EP | 1188409 | A2 | 3/2002 |
| EP | 0838190 | B1 | 2/2003 |
| EP | 0972487 | B1 | 3/2003 |
| FR | 2589057 | A1 | 4/1987 |
| WO | 9423286 | | 10/1994 |

OTHER PUBLICATIONS

International Search Report PCT/EP2003/09245.

* cited by examiner

*Primary Examiner* — Saeed T Chaudhry
(74) *Attorney, Agent, or Firm* — James E. Howard; Andre Pallapies

(57) ABSTRACT

A method for adapting a rinsing program in a dishwasher machine, and a dishwashing machine configured to perform the method, the method enabling the rinsing program run of a dishwasher machine to be adapted in such a way that satisfactory cleaning and drying performances are achieved even when using a combination rinse aid. To this end, the rinsing program run is adapted if there is insufficient salt, if the softening device is switched off, and if the dishwasher machine is on.

11 Claims, No Drawings

METHOD FOR ADAPTING A RINSING PROGRAM IN A DISHWASHER MACHINE, AND CORRESPONDING DISHWASHER MACHINE

CROSS-REFERENCE TO RELATED APPLICATIONS

This application is a continuation, under 35 U.S.C. §120, of U.S. application Ser. No. 11/043,237, filed Jan. 26, 2005, which is a continuation, under 35 U.S.C. §120 of PCT/EP2003/009245, filed Aug. 20, 2003, which designated the United States; this application also claims the priority, under 35 U.S.C. §119, to German Application No. 102 38 304.9, filed Aug. 21, 2002.

BACKGROUND OF THE INVENTION

The invention relates to a method for adapting a rinsing program in a dishwasher machine and a dishwasher machine for using this method.

In addition to the conventional use of dishwashing agent which is present in powder form and is inserted in a dishwashing agent dispensing device usually located in the door of the dishwasher machine and is dispensed by this at a pre-determined time and in addition to the use of liquid rinse aid which is also inserted in a dishwashing agent dispensing device usually located in the door of the dishwasher machine and is dispensed by this at a pre-determined time and in a pre-determined quantity, agents in tablet or gel forms of administration have been known for some time, which not only contain the actual dishwashing agent but also those components required as consumables during a rinsing phase. Thus, for example, combination products have been known for some time, so-called "2 in 1 tabs" or "2 in 1 gels" which contain the rinse aid in addition to the dishwashing agent and "3 in 1 tabs" or "3 in 1 gels" which in addition to the dishwashing agent and the rinse aid, also contain a chemical which replaces the function of the softening device. According to the idea of the manufacturers of these tabs or gels, the respective components are used precisely at that time during the rinsing program run at which these components have their optimal effect.

However, since the rinsing program run depends both on the rinsing program selected in each case, the manufacturer of the dishwasher machine and also on individual model types, the use of tabs or gels can have the result that for example, the rinse aid is released into the rinsing solution at a time when no rinsing is taking place so that in an actual partial program section "rinse", there is no more corresponding rinse aid. This is because in some known tabs or gels, the release of the rinse aid is merely coupled to the ambient temperature so that when this temperature is exceeded during a partial program section "clean", rinse aid is released.

In another embodiment of the rinsing program it can be that the rinse aid is not activated so that likewise no rinsing effect is achieved, but the rinse aid is still present in undissolved form, for example, after the end of the rinsing program.

Since the rinse aid usually primarily has the function of breaking down the surface tension of the rinsing solution, the lack of rinse aid in the rinsing solution results in reduced flowing away of the residual water remaining on the items to be cleaned in the partial program section "dry" which yields a substantially inferior drying result compared with the use of a rinsing solution with a rinse aid component.

When using tabs or gels with a corresponding chemical which replaces the function of the softening device, the disadvantage similarly arises that the quantity of chemical located in the tabs or gels is not matched to all degrees of water hardness so that depending on the particular region, the use of tabs or gels either reduces the degree of hardness too much or does not sufficiently reduce the degree of hardness. In particular, the use of water with insufficiently reduced water hardness results in a lower efficiency of the dishwashing agent and the rinse aid and a substantially inferior cleaning and drying result is thereby achieved.

As a consequence of this use of tabs or gels, the user of the dishwasher machine can detect that the cleaning performance and/or the drying performance is not satisfactory and in many cases causatively attributes this result to the dishwasher machine although the cause lies mainly in the use of tabs or gels.

BRIEF SUMMARY OF THE INVENTION

The object of the present invention is thus to provide a method which allows the rinsing program run of a dishwasher machine to be adapted so that even when using a wide range of combination dishwashing agents, a satisfactory cleaning and drying performance is achieved.

This object is solved by the method according to the invention with the features according to claim 1 and by the dishwasher machine with the features according to the further independent claim. Advantageous further developments of the inventions are characterised in the dependent claims.

DETAILED DESCRIPTION OF EXEMPLARY EMBODIMENTS OF THE PRESENT INVENTION

In the method for adapting a rinsing program in a dishwasher machine according to the invention, the rinsing program run is adapted if it is detected that no rinse aid has been added and if the dishwasher machine is operating and/or if it is detected that there is a lack of salt and if the softening device is switched off and if the dishwasher machine is operating. By detecting the lack of rinse aid in conjunction with the operation of the dishwasher machine, it is established that either the user has forgotten to put in the rinse aid or that the tabs or gels described are being used. By detecting the lack of salt in conjunction with a switched-off softening device and with the dishwasher machine being on, it can be established without any doubt that tabs or gels are being used. In all cases, an adaptation of the rinsing program without any intervention of the user is provided according to the invention to achieve a satisfactory cleaning and drying performance.

According to a preferred feature of the invention, if it is detected that no rinse aid has been added and if the dishwasher machine is operating, during the rinsing program the number of changes of the solution in a partial program step "intermediate rinse" is reduced and/or the number of changes of solution in a partial program step "rinse" and/or the duration of a partial program step "dry" and/or the temperature associated therewith is increased. A reduced number of changes of solution in the partial program step "intermediate rinse", which is usually operated with clear water, makes it possible to reuse the cleaning solution in the rinsing whereby, if necessary, this "carried away" solution can take over the rinsing functions. An elevated temperature of the rinsing solution, especially in rinsing makes it possible to achieve better evaporation of the residual liquid remaining on the items to be cleaned which have been heated with the rinsing solution and thus makes it possible to achieve a satisfactory drying result. Lengthening of the rinsing also helps to achieve satisfactory heating and satisfactory residual cleaning of the items to be cleaned. The increase in temperature in the rinsing naturally also brings about an increased temperature in the drying, this lengthening ensuring a better evaporation of the residual liquid.

According to a further preferred feature of the invention, if it is detected that there is no salt during the rinsing program, the softening device, despite being switched off, is started up to soften the water and that if necessary, a lack-of-salt display is started up despite being switched off. As a result of using softened water for the cleaning and rinsing, which is thereby made possible, a better efficiency of these additives is achieved. The lack-of-salt display started up despite being switched off shows the user the special case in the cleaning action.

The present invention has succeeded in providing a method which allows the rinsing program run of a dishwasher machine to be adapted so that a satisfactory cleaning and drying performance is achieved even when using a wide range of combination dishwashing agents.

More appropriately, the lack of consumables is detected by means of a level of consumables in an associated supply container being too low. Sensors usually present in any case are thus used for further advantageous measures.

According to an advantageous embodiment of the invention, the lack of consumables is detected by means of a sensor to measure the properties of the corresponding cleaning liquid. In contrast to the alkaline cleaning solution, the rinsing solution is acid when rinse aid is added. In addition to the higher degree of hardness, non-softened water also has a different pH to softened water. Thus, the sensor for measuring the properties of the rinsing solution is advantageously a pH sensor or a water hardness sensor.

With such a sensor the concentration of any rinse aid still present in the rinsing solution can be determined by a comparison with a pre-determined value. Thus, in an especially advantageous fashion during the rinsing program the number of changes of the solution in a partial program step "intermediate rinse" and/or "rinse" and/or the duration of a partial program step "dry" and/or the temperature associated therewith is adapted according to the detected value.

With such a sensor the residual hardness of the filled water can naturally also be determined by a comparison with a pre-determined value. Thus, in a likewise especially advantageous fashion, if it is detected that there is a lack of salt during the rinsing program, the softening device, despite being switched off, is started up to soften the water to a minimum value in accordance with the detected value and if necessary, a lack-of salt display is started up despite being switched off. Since it is known that the chemical contained in the tabs or gels, which should replace the function of the softening device, acts up to about 25° dH, the minimum degree of hardness according to the regulations is about 25° dH.

The aforesaid object is solved by a dishwasher machine according to the invention for using a method according to one of the preceding claims.

According to an advantageous embodiment of the invention, a sensor for measuring the properties of the corresponding cleaning liquid is arranged.

The sensor for measuring the properties of the corresponding cleaning liquid is advantageously a pH sensor or a water hardness sensor.

The present invention has succeeded in providing a method which allows the rinsing program run of a dishwasher machine to be adapted so that even when a wide range of combination dishwashing agents are used, a satisfactory cleaning and drying performance is achieved.

What is claimed is:

1. A method for operating a rinsing program in a dishwasher machine, comprising: adjusting a rinsing program including adjusting a predetermined set of executable steps of a rinsing program to an adjusted set of executable steps of the rinsing program in response to a selected one of a detection that no rinse aid has been added and the dishwasher machine is operating and a detection that there is an absence of salt above a predetermined minimum quantity, the softening device is switched off, and the dishwasher machine is operating, wherein adjusting the rinsing program in response to a detection that no rinse aid has been added and the dishwasher machine is operating includes commencing an operation of the softening device to soften the water.

2. The method according to claim 1, wherein commencing the operation of the softening device to soften the water to a minimum value includes commencing the operation of the softening device to soften the water to a minimum hardness of about 25° dH.

3. A method for operating a rinsing program in a dishwasher machine, comprising: adjusting the rinsing program in response to a detection that no rinse aid has been added and the dishwasher machine is operating, the adjusting includes one of reducing, during the rinsing program, a number of changes of the solution in a partial program step intermediate rinse, reducing a number of changes of solution in a partial program step rinse, reducing a duration of a partial program step dry, increasing a temperature associated with the partial program step dry and commencing an operation of the softening device to soften the water and, optionally, commencing an operation of a lack-of-salt display despite it being switched off.

4. A method for operating a dishwasher, comprising: determining whether an amount of salt exceeds a predetermined quantity, a softening device is switched off, and the dishwasher is operating; and adjusting an operation of the dishwasher in response to a detection that there is an absence of salt above a predetermined minimum quantity, the softening device is switched off, and the dishwasher machine is operating.

5. A dishwasher, comprising: a sensor that determines whether an amount of salt exceeds a predetermined quantity, a softening device is switched off, and the dishwasher is operating; and a controller for adjusting an operation of the dishwasher in response to a determination by the sensor that there is an absence of salt above a predetermined minimum quantity, the softening device is switched off, and the dishwasher machine is operating.

6. The dishwasher of claim 5, wherein the sensor senses a cleaning liquid to determine whether there is an amount of salt that exceeds a predetermined quantity, a softening device is switched off, and the dishwasher is operating.

7. The dishwasher of claim 5, wherein the sensor comprises a pH sensor or a water hardness sensor.

8. The dishwasher of claim 5, wherein the controller adjusts the operation of the dishwasher by one of reducing a number of changes of a solution in a partial program step intermediate rinse, reducing a number of changes of solution in a partial program step rinse, reducing a duration of a partial program step dry, and increasing a temperature associated with the partial program step dry.

9. The dishwasher of claim 5, wherein the controller adjusts the operation of the dishwasher in response to a detection that there is an absence of salt above a predetermined minimum quantity, the softening device is switched off, and the dishwasher machine is operating by providing a lack-of-salt display.

10. The dishwasher of claim 5, wherein the sensor determines whether a cleaning liquid exceeds a predetermined PH value of 25° dH, and wherein the controller instructs the softener to continue operating until the sensor determines that the PH value of the cleaning liquid exceeds the predetermined PH value of 25° dH.

11. The dishwasher of claim 5, wherein the sensor detects a level of salt in a salt supply container.

* * * * *